United States Patent [19]

Tasaki et al.

[11] Patent Number: 5,036,692

[45] Date of Patent: Aug. 6, 1991

[54] METHOD FOR BENDING PIPES AND APPARATUS THEREFOR

[75] Inventors: Shizuka Tasaki, Tokorozawa; Masaaki Tarui, Mishima, both of Japan

[73] Assignee: Taiyo Corporation, Tokyo, Japan

[21] Appl. No.: 598,179

[22] Filed: Oct. 15, 1990

[30] Foreign Application Priority Data

Apr. 4, 1990 [JP] Japan ..... 2-88335

[51] Int. Cl.[5] ..... B21D 9/05

[52] U.S. Cl. ..... 72/150; 72/370; 72/710

[58] Field of Search ..... 72/150, 710, 369, 370, 72/149

[56] References Cited

U.S. PATENT DOCUMENTS 2,854,055 9/1958 Brindley et al. ..... 72/150

FOREIGN PATENT DOCUMENTS 0199521 9/1986 Japan ..... 72/150

*Primary Examiner*—Lowell A. Larson

*Assistant Examiner*—M. J. McKeon

*Attorney, Agent, or Firm*—Frishauf, Holtz, Goodman & Woodward

[57] ABSTRACT

A method and an apparatus for bending pipes by clamping one end of the pipe between a formed roll and a rotary base and by turning the rotary base so that the pipe may be bent along the outer periphery of the formed roll. A mandrel supported by a mandrel bar is arranged inside the pipe at a position corresponding to a position slightly behind where the pipe is clamped between the formed roll and the rotary base. The rear end of the mandrel bar is held in place by a pressurizing device so that the mandrel can be held fixed at said predetermined position inside the pipe. At the same time, a vibrating device attached to the mandrel bar causes the mandrel to continuously reciprocate in the axial direction of said mandrel bar, whereby flattening of the pipe which occurs when the pipe is bent along the outer periphery of the formed roll can be corrected by the reciprocation of the mandrel. As a result, the radius of curvature R of the pipe can be made smaller than R=3D, where D is the diameter of the pipe.

15 Claims, 2 Drawing Sheets

METHOD FOR BENDING PIPES AND APPARATUS THEREFOR

BACKGROUND OF THE INVENTION AND RELATED ART STATEMENT

The present invention is related to bending of pipes, and more particularly to a method and an apparatus which allow metal pipes to be bent at a radius of curvature as small as possible relative to the pipe diameter.

As one prior art means for bending pipes, there is known a method in which a pipe 1 is pressed against the outer periphery of a formed roll 2 and turned as shown in FIG. 4. More specifically, one end of the pipe is clamped between a fixed clamp member 5*a* provided at one portion of the formed roll 2 and a movable clamp member 5*b* provided at one portion of a rotary base 3 which in turn is rotated about the rotary shaft 9 of said formed roll 2. By turning the rotary base 3 along the outer periphery of the formed roll 2, the pipe 1 is bent at the radius of curvature R of the formed roll 2.

A retaining base 4 for retaining the pipe 1 linearly in place is positioned at the rear of the rotary base 3. A mandrel 6 is inserted and held at a given position by means of a mandrel bar 7 inside the pipe 1 which in turn is retained by the retaining base 4. As shown in FIG. 4, the mandrel 6 is disposed at a position such that the tip 6*a* thereof extends slightly beyond a phantom line 10 which extends from the rotary shaft 9 of the roll 2 and intersects the axial line 8 of the pipe 6*a* at a normal angle. When one end of the pipe 1 is pulled and bent along the outer periphery of the roll 2 as the rotary base 3 is turned, the pipe surface on the outer side in respect of the roll 2 is pulled and tends to become flattened at a position slightly beyond the retaining base 4 as shown by the dash-and-dot line at 11. The tip end 6*a* of the mandrel 6 acts to prevent such flattening of the pipe.

As is clear from FIG. 4, the mandrel 6 is held firmly in place at a given position by means of the mandrel bar 7 because if the tip end 6*a* thereof extends unnecessarily beyond the phantom line 10, the mandrel 6 would get in the way and hamper the bending of the pipe 1.

The mandrel 6 disposed inside the pipe 1 helps prevent flattening of the pipe 1 at a location slightly beyond the retaining base 4 when the pipe 1 is bent by the turning of the rotary base 3. However, despite the presence of the mandrel within the pipe, it was still impossible in the prior art to bend pipes at curvatures that are small relative to the pipe diameter. As shown in FIG. 4, it is generally known that when the pipe diameter D and the radius of curvature R of the formed roll 2 hold the relation $R=3D$ at least, pipes can bent without deformation to the curve. In other words, when the relation between the pipe diameter and the radius of curvature of the formed roll is below $R=3D$, presence of the mandrel 6 inside the pipe 1 cannot prevent flattening 11 of the pipe 1 as indicated by the dash-and-dot line at a portion ahead the mandrel 6.

SUMMARY OF THE INVENTION

The present invention aims at obviating the above mentioned defect found in the prior art means for bending pipes and provides a method and an apparatus for bending pipes at curvatures R which are smaller than 3D without producing flattened portions.

More specifically according to the present invention, one end of a pipe is held between a formed roll, a rotary base and a retaining base. A mandrel bar provided with a mandrel at its tip is inserted inside the pipe at a position where the pipe is held by the retaining base. A hydraulic cylinder which is mounted on the rear end of the mandrel bar extending outward from the other end of the pipe retains the mandrel at said given position. A vibrator connected to said mandrel bar causes the mandrel to continuously reciprocate in the lateral direction, and the rotary base is turned about the outer periphery of the formed roll.

According to the present method, the pipe is flattened due to the tension caused when the pipe is bent along the outer periphery of the formed roll by the turning of the rotary base, the tip of the mandrel actively pushes forward and then pulls backward inside the pipe as the mandrel is subjected to continuous reciprocations inside the pipe. When said tip pushes forward and reaches the portion where flattening occurs, the bending of the pipe is momentarily resisted by the mandrel. However, as the mandrel is subsequently retracted, bending may continue without resistance. While the mandrel is retracted, said flattening may occur as the pipe is bent by the rotational force of the rotary base, the mandrel pushes forward again at the next moment, actively pressing against the flattening to restore the original shape, and then retracts again. As a result, while the mandrel repeats these movements, the rotary base is turned gradually about the formed roll and allows the pipe to be bent with a perfect curve even when $R \leqq 3D$ so long as the radius of curvature of the formed roll is larger than the pipe diameter. Although at the moments when the mandrel retracts flattening of the pipe does occur, it can be corrected as the mandrel pushes forward.

DETAILED DESCRIPTION OF PREFERRED EMBODIMENT

One embodiment of an apparatus for bending pipes according to the present invention will now be described referring to the accompanying drawings.

Figure 1:
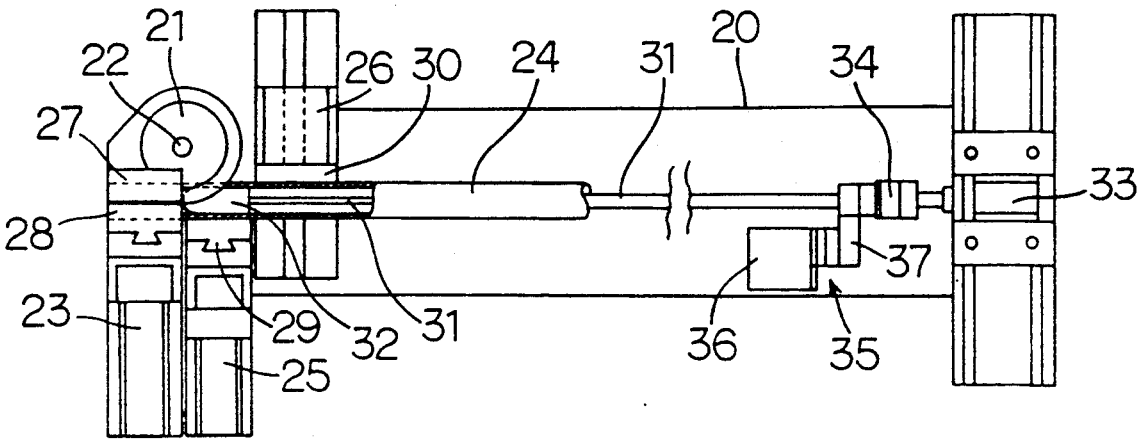
FIG. 1 is a plan view to show the construction of the apparatus for bending pipes according to the present invention.

FIG. 1 shows the overall construction of the apparatus according to the present invention. Similarly to the prior art apparatuses of this type, the present invention essentially comprises a formed roll 21 provided at one end of a table 20, a rotary base 23 which is turned about the rotary shaft 22 of the formed roll 21, a retaining base 25 and a wiper base 26 which hold a pipe 24 horizontally in place along the longitudinal direction of the table 20.

Figure 2:
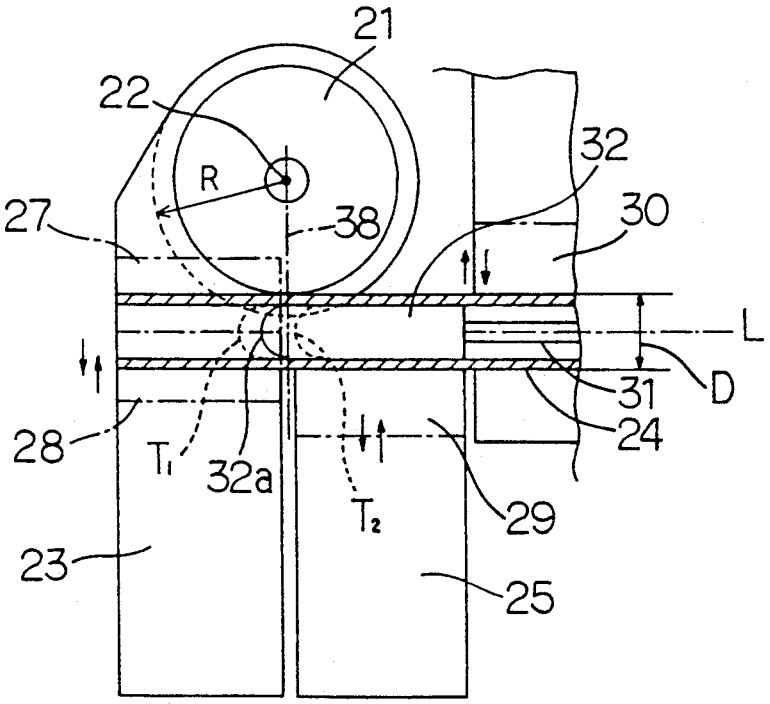
FIG. 2 is a partially exploded plan view to show the essential parts shown in FIG. 1.

As shown in FIG. 2, the diameter of the formed roll 1 is such that the radius of curvature R thereof is larger than the diameter D of the pipe 24 and smaller than 3D. The formed roll 21 is provided with a fixed clamp piece 27 at one portion thereof, and a movable fixed clamp piece 28 which is used in combination with said clamp piece 27 is provided on said rotary base 23. As the movable clamp piece 28 moves in the direction indicated by the arrow in FIG. 2, one end of the pipe 24 is held between the clamp pieces 27 and 28. The retaining base 25 and the wiper base 26 are also provided with a movable clamp piece each (29, 30) respectively. A mandrel bar 31 having a mandrel 32 at its tip end is arranged in the longitudinal direction of the table 20 on its upper surface. The mandrel 32 is disposed at a position corresponding to the position of the movable clamp piece 29. The rear end of the mandrel bar 31 having the mandrel 32 extends toward the rear of the table 20 and is connected with a hydraulic cylinder 33 arranged on the upper surface of the table 20 at the rear end by means of a joint 34. The hydraulic cylinder 33 firmly holds the mandrel 32 in place at said position which corresponds to the position of the retaining base 25.

A vibrating device 35 is mounted on the mandrel bar 31 near the position where the mandrel bar 31 is connected to the hydraulic cylinder 33 for reciprocating the mandrel 32 in its axial direction. The vibrating device 35 comprises an electromagnetic vibrator 36 which causes the mandrel bar 31 to reciprocate in its longitudinal direction, and a vibrating plate 37 which transmits the vibration to the mandrel bar for 31 from the vibrator 36. The vibrating plate 37 is connected to the mandrel bar 31 so that when the vibrating plate 37 is vibrated by the vibrator 36, the mandrel 32 is continuously reciprocated in the longitudinal direction via the mandrel bar 31.

As shown by the solid line in FIG. 2, the initial position of the mandrel 32 before it starts the reciprocating movements activated by the vibrating device 35 is such that the crown 32*a* thereof is located beyond a phantom line 38 which extends from the rotary shaft 22 of the formed roll 21 toward the rotary base 23 to intersect the axial line L of the pipe 24 at a normal angle. Therefore, when the mandrel bar 31 is vibrated by the vibrating device 35, the crown 32*a* of the mandrel 32 reciprocates between the two points T1 and T2 indicated by the dotted lines that are located on both sides of said initial position indicated by the solid line. The amplitude and the number of vibrations (i.e., vibration rate) of the mandrel 32 can be suitably selected by so controlling the vibrating device 35 depending on the given conditions such as the radius of curvature of the pipe to be obtained, the pipe diameter, and the pipe material.

Although an electromagnetic vibrator 36 is used as the vibrating device 35 for the mandrel bar 31 in the above described embodiment, the present invention is not limited to electromagnetic vibrators, and any vibrating means such as a vibrating motor or an eccentric cam may be used.

To bend a pipe, movable clamp pieces 28, 29 and 30 on the rotary base 23, the retaining base 25 and the wiper base 26 respectively are released, the and one end of the pipe 24 is passed between the movable clamp piece 28 of the rotary base 23 and a fixed clamp piece 27 of the formed roll 21 toward the hydraulic cylinder 33 to receive the mandrel 32. As the pipe 24 is arranged on the table 20, the clamp 28 of the rotary base 23 is closed to hold the pipe 24 between the clamp 28 and the fixed clamp piece 27 of the formed roll 21. Similarly, the movable clamp pieces 29 and 30 of the retaining base 25 and the wiper base 26 are moved toward each other to clamp the pipe 24 between the two pieces 29, 30. Since a flexible material such as rubber is used inside the clamp piece 30 of the wiper base 26, the pipe 24 can be freely moved in the axial direction while being held horizontally on the table 20 by the movable clamp pieces 29 and 30.

With the pipe 24 thus arranged horizontally on the table 20, the vibrating device 35 is actuated to cause reciprocation of the mandrel 32 when the mandrel 32 is held in place at the above-mentioned predetermined position inside the pipe 24 by means of a hydraulic cylinder 33. At the same time, the rotary base 23 is turned along the outer periphery of the formed roll 21 at a speed slower than the number of vibrations (i.e., vibration rate) of the mandrel 32 caused by the vibrating device 35.

Figure 3:
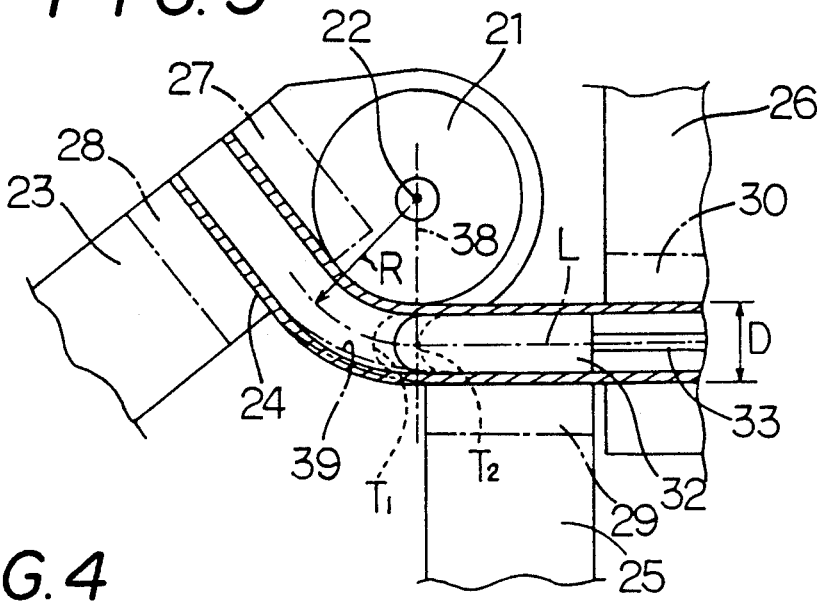
FIG. 3 is a plan view to show the process of bending a pipe according to the present invention.
Figure 4:
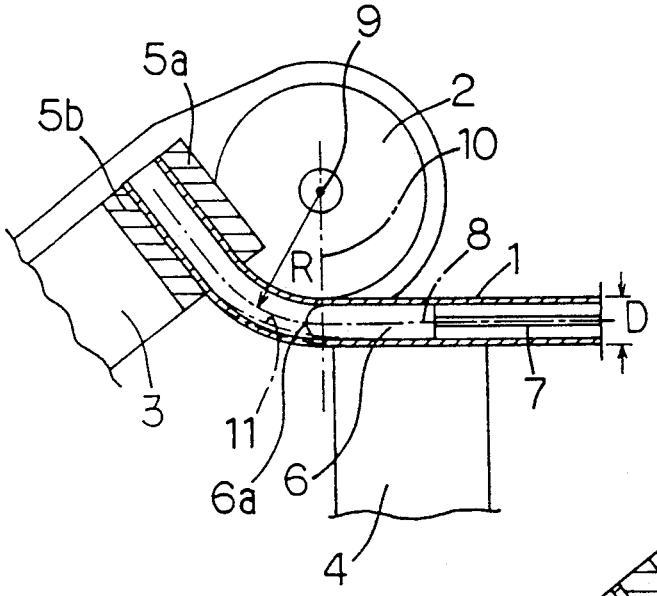
FIG. 4 is a plan view to show the process of bending a pipe using a prior art apparatus.
Figure 5:
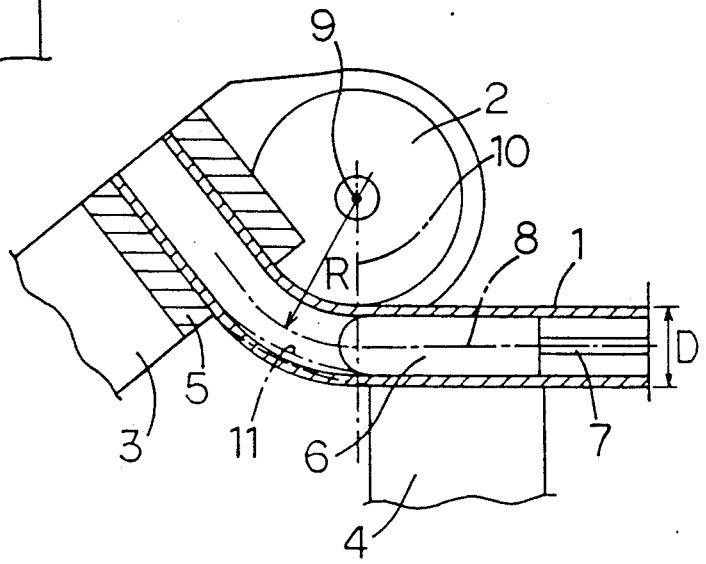
FIG. 5 shows a pipe being bent at a small curvature using a prior art apparatus.

As shown in FIG. 3, if the radius of curvature R of the formed roll 21 is smaller than the value three times the diameter D of the pipe 24, flattening 39 of the pipe 24 occurs due to tension at a portion ahead of the mandrel 32 when the pipe 24 is bent along the outer periphery of the formed roll 21 by turning the rotary base 23, as indicated by the dash-and-dot line. The flattening 39 is more likely to occur when the mandrel 32 is retracted to a position denoted as T2; however, as the mandrel 32 is continuously reciprocating between the points T1 and T2 at a speed faster than the turning speed of the rotary base 23, the flattening 39 which occurs when the mandrel 32 is retracted to the point T2 can be restored at the next moment when the mandrel 32 advances to the point T1. And since the rotary base 23 is gradually turned forward each time the mandrel 32 corrects the flattening 39, the pipe 24 can be eventually bent with a perfect and small curvature without flattening.

As has been described in the foregoing, the method and apparatus for bending pipes according to the present invention allows bending of pipes at curvatures smaller than $R=3D$ that were conventionally not attainable without flattening. The invention thus offers a wider scope of application.

What is claimed is:

1. A method for bending pipes, comprising:

holding one end of a pipe on a table by clamping one end of said pipe between a formed roll and a rotary base, and retaining the held pipe in position by a retaining base;

inserting a mandrel bar with a mandrel at a tip end portion thereof into the pipe such that the end portion of the mandrel is at a position which corresponds to a position slightly behind where the pipe is clamped between the formed roll and the rotary base;

pressing and holding the mandrel in place at said position slightly behind where the pipe is clamped, by means of a pressurizing device provided at a rear end portion of the mandrel bar which presses the mandrel bar toward said position;

actuating a vibrating device which is coupled to the mandrel bar to cause the mandrel to continuously reciprocate in the axial or longitudinal direction of the held pipe; and turning the rotary base along the outer periphery of the formed roll to bend the held pipe while the mandrel is continuously reciprocated in said axial or longitudinal direction.

2. The method of claim 1, wherein:

the mandrel has a crown portion at the end thereof;

the formed roll comprises a rotary shaft;

the initial position of the mandrel inside the pipe is such that the crown portion of the mandrel projects slightly toward the rotary base beyond a line which extends from the rotary shaft of the formed roll and intersects an axial line of the pipe at a substantially normal angle; and the mandrel is continuously reciprocated axially on both sides of said initial position as the mandrel bar is continuously reciprocated by said vibrating device.

3. The method of claim 1, wherein the radius of curvature R of the pipe is greater than R=1D; where D is the pipe diameter, and smaller than R=3D; and wherein the pipe is bent using a formed roll whose radius of curvature R is greater than R=1D and smaller than R=3D.

4. The method of claim 1, wherein the pipe is held horizontally on the table.

5. The method of claim 1, wherein the mandrel is continuously vibrated axially at a speed faster than the turning speed of the rotary base during bending of the pipe.

6. Apparatus for bending pipe, comprising:

means for holding a pipe on frame, and including means for clamping one end of said pipe between a formed roll and a rotary base, and a retaining base for retaining the pipe in place;

a mandrel bar with a mandrel at a tip end portion thereof, the mandrel being arranged inside the pipe so that the mandrel is at a position which corresponds to a position slightly behind where the pipe is clamped between the formed roll and the rotary base;

means for turning the rotary base along the outer periphery of the formed roll; and vibrating means coupled to the mandrel bar for causing continuous reciprocation of the mandrel along the axial direction of the held pipe; and pressing means coupled to a rear end portion of the mandrel bar for pressing the mandrel bar for retaining the mandrel in place at a position slightly behind where the pipe is clamped, during the vibration of the mandrel pipe.

7. The apparatus of claim 6, wherein said vibrating means comprises an electromagnetic vibrator which has a variable vibration frequency and amplitude.

8. The apparatus of claim 6, wherein said vibrating means comprises an eccentric cam.

9. The apparatus of claim 6, wherein said vibrating means comprises an electromagnetic vibrator.

10. The apparatus of claim 6, wherein said vibrating means has a variable vibration frequency and amplitude.

11. The apparatus of claim 6, wherein said pressing means presses the mandrel bar in the direction of the mandrel.

12. The apparatus of claim 11, wherein said pressing means comprises a hydraulic cylinder.

13. The apparatus of claim 6, wherein said vibrating means has a variable vibration frequency, and wherein said vibrating means continuously reciprocates said mandrel at a speed faster than the turning speed of the rotary base during bending of the pipe.

14. The apparatus of claim 6, wherein:

the mandrel has a crown portion at the end thereof;

the formed roll comprises a rotary shaft;

the mandrel bar positions the mandrel inside the pipe such that the crown portion of the mandrel projects slightly toward the rotary base beyond a line which extends from the rotary shaft of the formed roll and intersects an axial line of the pipe at a substantially normal angle; and the vibrating means continuously reciprocates the mandrel axially on both sides of said initial position as the mandrel bar is continuously reciprocated by the vibrating means.

15. The apparatus of claim 6, wherein the formed roll has a radius of curvature R which is greater than R=1D and smaller than R=3D, where D is the pipe diameter.

* * * * *